US005272506A

United States Patent [19]

Goto et al.

[11] Patent Number: 5,272,506

[45] Date of Patent: Dec. 21, 1993

[54] CONTACTABLE CHARGING DEVICE FOR APPLYING AN OSCILLATING VOLTAGE, PROCESS CARTRIDGE AND IMAGE FORMING APPARATUS USING THE SAME

[75] Inventors: Masahiro Goto; Takahiro Inoue; Hiroshi Sasame, all of Yokohama; Shinichi Tsukida, Okegawa; Manabu Takano, Machida, all of Japan

[73] Assignee: Canon Kabushiki Kaisha, Tokyo, Japan

[21] Appl. No.: 921,688

[22] Filed: Jul. 30, 1992

[30] Foreign Application Priority Data

Jul. 31, 1991 [JP] Japan ..... 3-192042

[51] Int. Cl.[5] ..... G03G 15/02

[52] U.S. Cl. ..... 355/219; 355/222; 355/271; 361/225

[58] Field of Search ..... 355/219, 222, 210-213, 355/200, 274, 273, 271; 361/212, 214, 221, 225, 235

[56] References Cited

U.S. PATENT DOCUMENTS

| | | | |
|---|---|---|---|
| 4,522,893 | 6/1985 | Bohlen et al. | 428/641 |
| 4,774,541 | 9/1988 | Martin et al. | 118/653 X |
| 4,985,716 | 1/1991 | Hosaka et al. | 346/159 |
| 5,164,779 | 11/1992 | Araya et al. | 355/219 |
| 5,182,604 | 1/1993 | Asai | 355/273 |
| 5,184,180 | 2/1993 | Choi | 355/219 |
| 5,196,885 | 3/1993 | Takeuchi et al. | 355/219 |

FOREIGN PATENT DOCUMENTS

| | | |
|---|---|---|
| 0272072 | 6/1988 | European Pat. Off. . |
| 0329366 | 8/1989 | European Pat. Off. . |
| 63-149669 | 6/1988 | Japan . |
| 2-38289 | 3/1990 | Japan . |
| 3-45981 | 2/1991 | Japan . |

*Primary Examiner*—A. T. Grimley
*Assistant Examiner*—T. A. Dang
*Attorney, Agent, or Firm*—Fitzpatrick, Cella, Harper & Scinto

[57] ABSTRACT

An image forming apparatus includes an image bearing member; a charging member contactable to the image bearing member to electrically charge the image bearing member, wherein an oscillating voltage is applied between the charging member and the image bearing member; wherein a specific weight $\sigma$ of the image bearing member defined by weight of an effective charging zone of the image bearing member (g) divided by (cross-sectional area thereof ($cm^2$) $\times$length of effective charging zone (cm)) and a frequency f (Hz) of the oscillating voltage satisfy:

$$\sigma \geqq 1.4\times10^{-3}\times f (200 \leqq f \leqq 350 \text{ Hz})$$

$$\sigma \geqq 4.0\times10^{-4}\times f+0.35, (350 \text{ Hz} < f \leqq 1500 \text{ Hz})$$

$$\sigma \geqq 0.95, (f > 1500 \text{ Hz}).$$

14 Claims, 9 Drawing Sheets

CONTACTABLE CHARGING DEVICE FOR APPLYING AN OSCILLATING VOLTAGE, PROCESS CARTRIDGE AND IMAGE FORMING APPARATUS USING THE SAME

FIELD OF THE INVENTION AND RELATED ART

The present invention relates to a charging (discharging) device contactable to a member to be charged such as an electrophotographic photosensitive member to electrically charge or discharge it, a process cartridge including such a charging device and an image forming apparatus including the same.

The type of charging device is known in the field of an image forming apparatus such as an electrophotographic machine. In this type of the device, a charging member in the form of a conductive or blade is contacted to the surface of the electrophotographic photosensitive member (the member to be charged), and an oscillating voltage in the form of a DC biased AC voltage is applied therebetween to form an oscillating electric field to charge the photosensitive member.

This type of the charging device involves a problem of so-called charging noise produced by the oscillating electric field between the photosensitive member and the charging member. The mechanism of the production of the noise has been found. When the oscillating electric field is formed, the photosensitive member and the charging member are attracted electrostatically to each other. At the maximum and minimum peaks of the oscillating voltage, the attraction force is large, so that the charging member is pressed and deformed to the photosensitive member. At the center of the oscillation, the attraction force is small, and therefore, the charging member tends to be away from the photosensitive member due to the restoration of the charging member. Therefore, the vibration is produced at the frequency which is twice the frequency of the oscillating voltage.

The charging member and the photosensitive member are rubbed with each other. When the attracting electrostatic force is large at the maximum and minimum peaks of the oscillating voltage, the charging member is attracted strongly to the photosensitive member with the result of the relative movement being retarded. On the contrary, at the center of the oscillating voltage, the attracting force is small so that the relative movement is not retarded. Therefore, the vibration is also caused by stick and slip, as when a wet glass is rubbed with a finger. This vibration also has a frequency which is twice the frequency of the applied oscillating voltage.

The vibration is a forced vibration caused by the oscillating voltage applied to the charging member, and is in the same phase along the length (generating line direction) of the electrophotographic photosensitive member. Therefore, there is no node or antinode. Thus, the vibration occurs only in the circumferential direction. It is known as disclosed in Japanese Laid-Open Patent Application No. 45981/1991 that plural vibration buffers are mounted by bonding material to prevent resonance in the direction of the length of the photosensitive drum. However, the above discussed vibrations are totally different ones. In addition, Japanese Laid-Open Utility Model Application No. 38289/1990 proposes that the inside of a thin metal drum of electrophotographic photosensitive member is filled with foamed material to provide a large thermal capacity and high mechanical strength. However, the filling foamed material is not effective to suppress the vibration since it does not have the effect of suppressing the forced vibration.

As described, when the oscillating voltage is applied between the charging member and the photosensitive member, the charging noise is generated by vibration. The basic frequency of the noise is twice the frequency of the applied oscillating voltage. If the oscillating voltage includes 300 Hz AC voltage, the produced noise has the component of 600 Hz. The noise may include a higher frequency which is an integer multiple of that frequency. In some cases, the noise includes the frequency component which is an integer multiple of the frequency of the applied oscillating voltage.

The noise includes air noise produced directly from the contact area between the charging member and the photosensitive member and solid noise which is caused by vibration of the photosensitive member being transmitted to the process cartridge and/or to the main assembly of the image forming apparatus and then causes the noise, wherein the process cartridge includes the photosensitive member and is detachably mountable to the image forming apparatus. In total, the latter noise is more significant.

The charging noise is influenced by the frequency of the oscillating voltage applied to the charging member. More particularly, when the frequency is not more than 200 Hz, the noise is not so significant acoustically or in data. However, if it is higher, the noise is increasingly significant acoustically in proportion to the frequency. It generally increases until the frequency is 1000–1500 Hz, including mall peaks and bottoms due to the resonance of the photosensitive member. Above 1500 Hz, it gradually decreases.

In the case of the contact charging, cycle marks may be produced due to the oscillating electric field between the member to be charged and the charging member supplied with the oscillating voltage. Therefore, when the process speed (the peripheral speed of the photosensitive member) is increased, a higher charging frequency is desired. In the case of the digital image recording as in the laser beam printer, moire patterns are produced due to the combination of the cycle marks and the repeating frequency of the digital image. Therefore, a higher frequency is desired to avoid the problem. However, this tends to increase the charging noise.

Additionally, the recent demand is toward the small size of the image forming apparatus which contains the charging device. When the size is small, the charging noise from the charging device or the process cartridge containing it is not easily absorbed or dissipated in the image forming apparatus. This also increases the charging noise.

SUMMARY OF THE INVENTION

Accordingly, it is a principal object of the present invention to provide a charging device, a process cartridge and an image forming apparatus in which the charging noise is decreased.

It is another object of the present invention to provide a charging device, a process cartridge and an image forming apparatus in which deformation of the member to be charged such as an image bearing member is suppressed, thus suppressing the vibration due to the deformation.

It is a further object of the present invention to provide a charging device, a process cartridge and an image forming apparatus in which a cyclic unevenness is prevented, and a high speed operation is possible.

While the invention has been described with reference to the structures disclosed herein, it is not confined to the details set forth and this application is intended to cover such modifications or changes as may come within the purposes of the improvements or the scope of the following claims.

DESCRIPTION OF THE PREFERRED EMBODIMENTS

Figure 1:
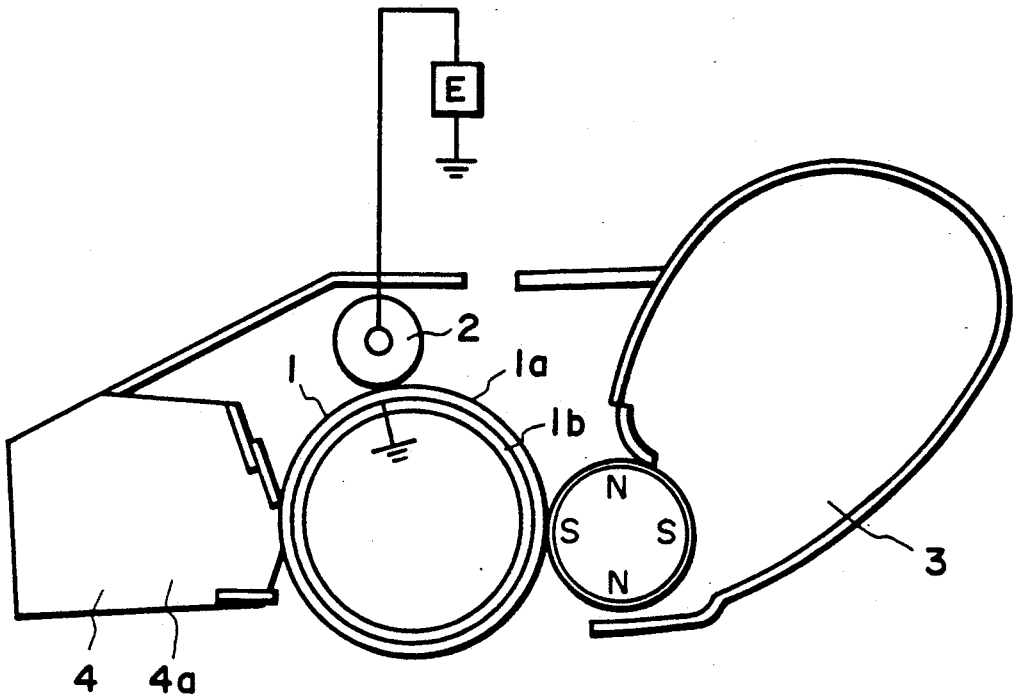
FIG. 1 is a side view of a process cartridge according to an embodiment of the present invention.

Referring to FIG. 1, there is shown a process cartridge containing a contact type charging device according to a first embodiment of the present invention. In this embodiment, the charging member of the contact type charging device is in the form of a conductive roller 2 (charging roller). The electrophotographic photosensitive member is in the form of a photosensitive drum 1 comprising a grounded conductive cylinder lb of aluminum, iron, stainless steel or the like and an organic photoconductor (OPC) layer 1*a* having a thickness of 20 microns.

The process cartridge of this embodiment is designed for a laser beam printer. The charging roller 2 contacted to the photosensitive drum 1 uses a charging method disclosed in Japanese Laid-Open Patent Application No. 149669/1988, in which the charging member is supplied from a voltage source E with an oscillating voltage which is in the form of a combination of a DC voltage of −500−−700 V and a sine wave AC voltage having a peak-to-peak voltage of 1600–2000 V, by which an oscillating electric field is formed between the photosensitive drum 1 and the charging roller 2, by which the photosensitive drum 1 is electrically charged to a predetermined potential. The photosensitive drum 1 uses an OPC which is sensitized in the infrared range. When the laser beam (not shown) is projected thereto through the opening of the process cartridge, the potential of the projected portion decreases, so that an electrostatic latent image is produced. A developing device 3 uses one component toner which is charged to the negative polarity, and is of a jumping development type. It effects the reverse development so that the toner particles are deposited to the areas on the photosensitive member where the potential is low. The toner image is transferred from the photosensitive drum 1 onto a transfer material, and thereafter, the residual toner thereon is removed by a counter-blade type cleaner 4. The removed toner particles are collected in the cleaner container 4*a*. The above means are constituted as a unit or a process cartridge. The process unit is detachably mountable to the laser beam printer. However, the process cartridge may contain at least the photosensitive drum 1 and the charging roller 2.

Various investigations have been made in order to solve the problem of the charging noise, and as a result, it has been found that there is a strong relation between the charging noise and the specific gravity of the photosensitive drum 1 (the definition will be described hereinafter in detail) and between the charging noise and the frequency of the oscillating voltage applied between the charging roller 2 and the photosensitive drum 1. Therefore, by properly selecting the parameters, the charging noise can be effectively prevented.

EXPERIMENT 1

Figure 2:
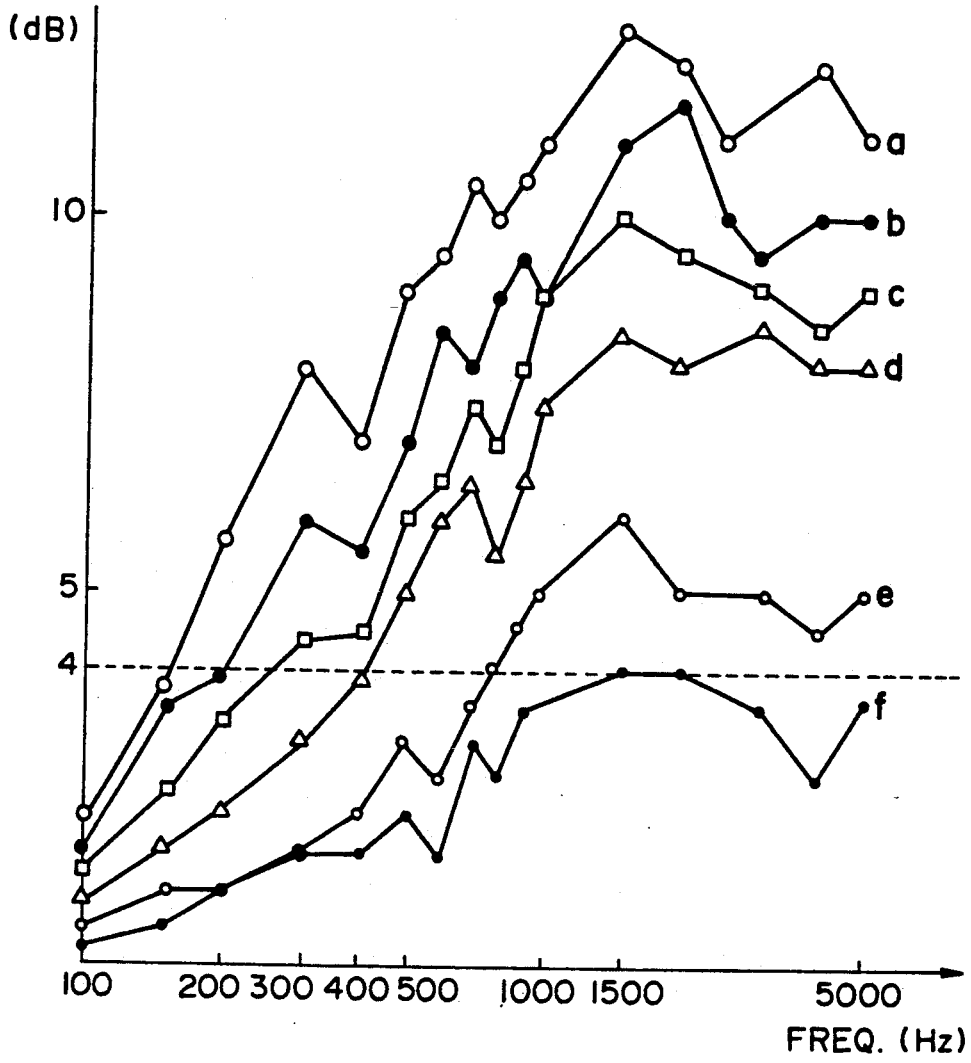
FIG. 2 is a graph of a relation between a charging frequency and charging noise.
Figure 3:
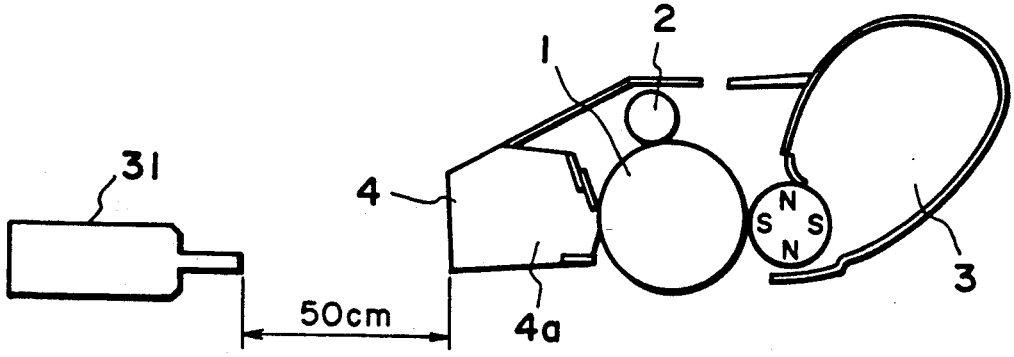
FIG. 3 is a schematic view illustrating charging noise measurement.

The photosensitive drum 1 is rotated in a bare process cartridge, while an AC voltage of a sine wave is applied to the charging roller. During this, the frequency of the AC voltage component is changed, and the charging noise produced from the process cartridge is measured. The results of experiments are shown in FIG. 2. As for the measurement of the charging noise, the process cartridge is placed in an anechoic chamber, and a normal noise meter 31 (NL-02, available from Rion) at a position 50 cm away from the cleaner of the process cartridge, as shown in FIG. 3. The noise pressure level of the charging noise is measured in A-characteristics. The used charging roller 2 comprises an electrically conductive core metal (circular rod) having a diameter of 6 mm and an elastic layer thereon of EPDM (ethylene propylene diene tercopolymer) having an electric conductivity and having a thickness of 3 mm, and further a nylon layer in which carbon particles are dispersed and which has a thickness of 20 microns. The roller hardness is 60 degrees (Asker C, 1 kgf). The resistance of the roller is $10^5$–$10^6$ Ω. The resistance is determined as follows. An aluminum cylinder having the same dimension as the photosensitive drum 1 is prepared. The charging roller 2 is contacted thereto, and a 500 g load is applied at each of the longitudinal ends of the charging roller 2. Then, 300 V DC voltage is applied to the charging roller. The electric currents flowing through the aluminum cylinder is measured, and the resistance is determined on the basis of the measured current. The AC voltage applied to the charging roller 2 is in the form of a sine wave, and the peak-to-peak voltage thereof was 2000 V. To the AC voltage, −600 V DC voltage was added. The peripheral speed of the rotating photosensitive drum 1 is 50 mm/sec. The photosensitive drum 1 is coated with an OPC layer 20 microns thick, and the aluminum cylinder thereof has a diameter of 30 mm.

Referring to FIG. 2, there is shown a relation between the frequency of the AC voltage (abscissa) and a difference between the noise pressure at the time when the photosensitive drum is rotated with application of the charging voltage and the noise pressure at the time when the DC biased AC voltage is applied to the charging roller 2 (ordinate). The noise pressure level when the charging voltage was not applied was 45 dB. The investigations and experiments by the inventors have revealed that the charging noise is not significant if the noise pressure level difference is not more than 4 dB, according to panel tests using plural persons. The charging noise suppressing effect has been evaluated on the basis of this result.

A solid line a in the graph of FIG. 2 represents the case of aluminum cylinder of the photosensitive drum having a thickness of 0.6 mm; a solid line b, for 0.8 mm; solid line c, for 1.0 mm; a solid line d, for 1.5 mm; a solid line e, for 2.0 mm; and a solid line f, for 3.0 mm. From this graph, the relation between the frequency and the thickness of the aluminum cylinder when the charging noise is not significant, is as follows:

TABLE 1

| Thickness of Aluminum Cylinder (mm) | 0.6 | 0.8 | 1.0 | 1.5 | 2.0 | 3.0 |
|---|---|---|---|---|---|---|
| Frequency (Hz) | 150 | 200 | 250 | 400 | 800 | — |

From the graph of FIG. 2 and the above Table 1, it will be understood that the charging noise can be prevented over any frequency range if the thickness of the aluminum cylinder of the photosensitive drum 1 is not less than 3 mm and that even if the thickness of the aluminum cylinder is less than 3 mm, the charging noise can be made insignificant depending on the charging frequency.

EXPERIMENT 2

The similar experiments as in Experiment 1 have been conducted using a process cartridge containing a photosensitive drum having a diameter of 60 mm. The experimental conditions and parameters are the same as in Experiment 1, except for the diameter of the photosensitive drum, and therefore, the detailed description thereof are omitted.

Figure 4:
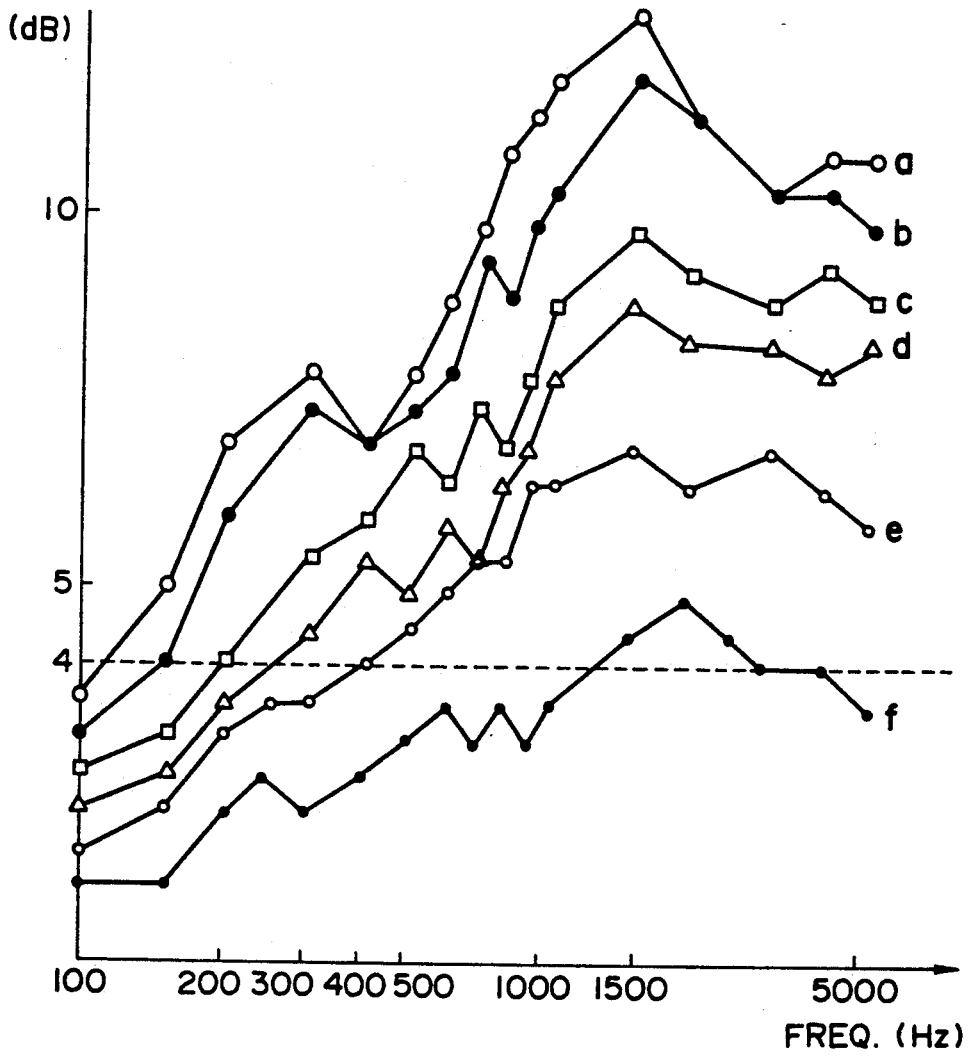
FIG. 4 is a graph of a relation between a charging frequency and a charging noise.

FIG. 4 is a graph showing a relation among the charging frequency, the thickness of the aluminum cylinder and the charging noise. The ordinate is the same as in FIG. 2. A solid line a represents the aluminum cylinder having a thickness of 0.8 mm; a solid line b, for 1.0 mm; a solid line c, for 1.5 mm; a solid line d. for 2.0 mm a solid line e. for 3.0 mm; and a solid line d, for 5.0 mm. From this graph, the frequency with which the charging noise is not significant or not bothering is as follows, for the thicknesses of the aluminum cylinder.

TABLE 2

| Thickness of Aluminum Cylinder (mm) | 0.8 | 1.0 | 1.5 | 2.0 | 3.0 | 5.0 |
|---|---|---|---|---|---|---|
| Frequency (Hz) | 100 | 150 | 200 | 250 | 400 | 1200 |

From the graph of FIG. 4 and Table 2, it appears the same thing as in Experiment 1 applies to the case of the aluminum cylinder having the diameter of 60 mm. From the results of Experiments 1 and 2, the relation between the charging noise and the cross-sectional area, as well as, the relation between the charging noise and the thickness of the aluminum cylinder of the photosensitive drum, is expected.

Figure 5:
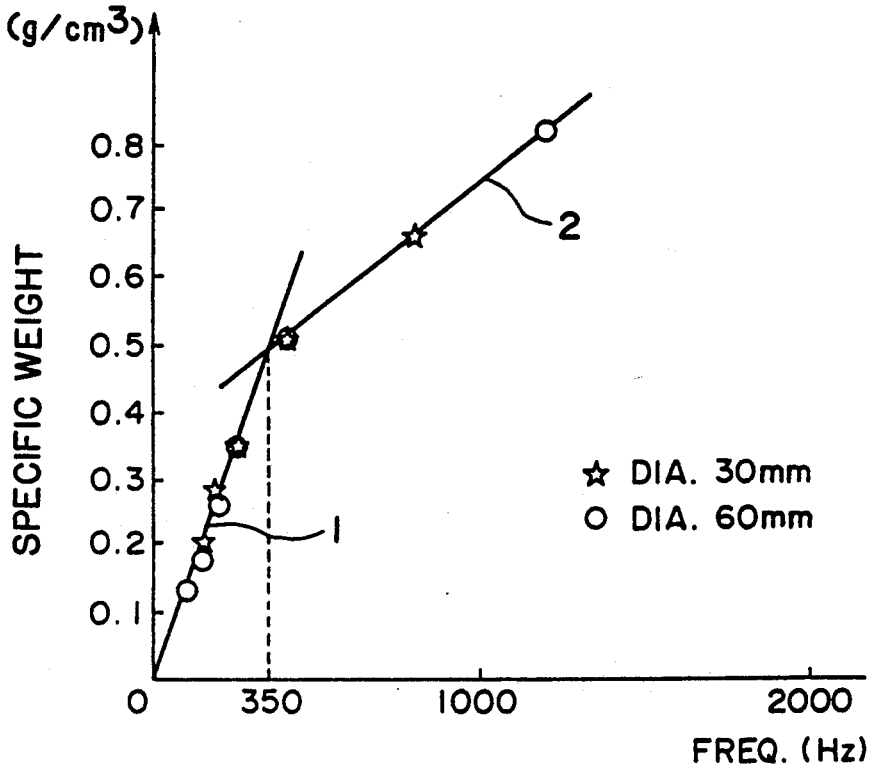
FIG. 5 is a graph of a relation between a charging frequency and a specific weight of the photosensitive drum.

FIG. 5 shows a relation, obtained from the results of Experiments 1 and 2, between the specific weight $\sigma$ of the photosensitive drum and the frequency of the oscillating voltage with which the charging noise is not significant. The specific weight $\sigma$ is defined as follows:

$\sigma$=[weight (g) of the photosensitive drum per unit length (cm)]/ [cross-sectional area of the photosensitive drum, that is the area ($cm^2$) of a circle of the outer diameter of the aluminum cylinder]

Since the thickness of the photosensitive layer is negligibly small as compared with the outer diameter of the aluminum cylinder, the cross-sectional area of the photosensitive drum including the photosensitive layer is deemed as being equal to the area of the circle having a diameter which is the same as the outer diameter of the aluminum cylinder.

In addition, since the specific weight of the photosensitive layer is negligibly small as compared with that of the cylinder supporting it, the specific weight of the photosensitive layer is neglected. Therefore, the specific weight of the photosensitive drum is the specific weight of the member supporting the photosensitive layer.

The entire length of the photosensitive drum is conducted by the charging roller, and therefore, the total length of the drum is the same as the effective charging area.

Table 3 below shows a relation between a specific weight and a thickness of the aluminum cylinder of the photosensitive drum.

TABLE 3

| O. Diameter of Al Cylinder (cm) | Thickness of Al Cylinder (cm) | Specific weight ($g/cm^3$) |
|---|---|---|
| 3 | 0.06 | 0.21 |
| 3 | 0.08 | 0.28 |
| 3 | 0.10 | 0.35 |
| 3 | 0.15 | 0.51 |
| 3 | 0.20 | 0.67 |
| 3 | 0.30 | 0.97 |
| 6 | 0.08 | 0.14 |
| 6 | 0.10 | 0.18 |
| 6 | 0.15 | 0.26 |
| 6 | 0.20 | 0.35 |
| 6 | 0.30 | 0.51 |
| 6 | 0.50 | 0.83 |

The specific weight $\sigma$ is expressed:

$$\sigma=\{(D/2)^2-(D/2-t)^2\}\times 2.7/(D/2)^2$$

where D is an outer diameter of an aluminum cylinder (cm), t is a thickness (cm), and the specific weight of the aluminum is 2.7 ($g/cm^3$).

As will be understood from the graph of FIG. 5, the relation between a charging frequency f (Hz) and the specific weight $\sigma$ ($g/cm^3$) of the aluminum cylinder supporting the photosensitive layer with which the charging noise is not significant, can be generally represented by a rectilinear line, expressed by:

$$\sigma \geqq 1.4\times 10^{-3}\times f,\ (f \leqq 350\ Hz) \qquad \text{line 1}$$

$$\sigma \geqq 4\times 10^{-4}\times f+0.35,\ (350\ Hz < f \leqq 1500\ Hz) \qquad \text{line 2}$$

$$\sigma \geqq 0.95,\ (f > 1500\ Hz) \qquad \text{line 3}$$

Since the noise which is acoustically bothering, that is, significant has the frequency not less than 200 Hz, the above equations are particularly effective with the charging frequency not less than 200 Hz. As described hereinbefore, with the increase of the process speed of the photosensitive member, the necessity arises to avoid cycle marks and moire patterns, and therefore, the oscillating frequency is at least 200 Hz. Therefore, the line 1 is effective in the following range.

$$\sigma = 1.4 \times 10^{-3} \times f \ (200 \leqq f \leqq 350) \quad (2)$$

The description will be made as to the reasons why the preferable range of the specific weight of the photosensitive drum is larger than a constant level when the charging frequency is not less than 1500 Hz.

As will be understood from the graphs of FIGS. 2 and 4, the noise pressure level of the charging noise does not increase when the charging frequency is not less than 1500 Hz. Rather, the pressure level decreases with increase of the, frequency, as the case may be. It is understood that the discomfort increases more than expressed by the noise pressure level alone, in this range. For this reason, the experiments have been carried out as to the discomfort of the charging noise not only in the noise pressure level (the panel tests by plural persons as in the foregoing experiments). As a result, it has been found that the charging noise is not a discomfort in the range not less than 1500 Hz if the photosensitive drum that has such a specific weight has to suppress the charging noise only at 1500 Hz of the charging frequency.

Figure 6:
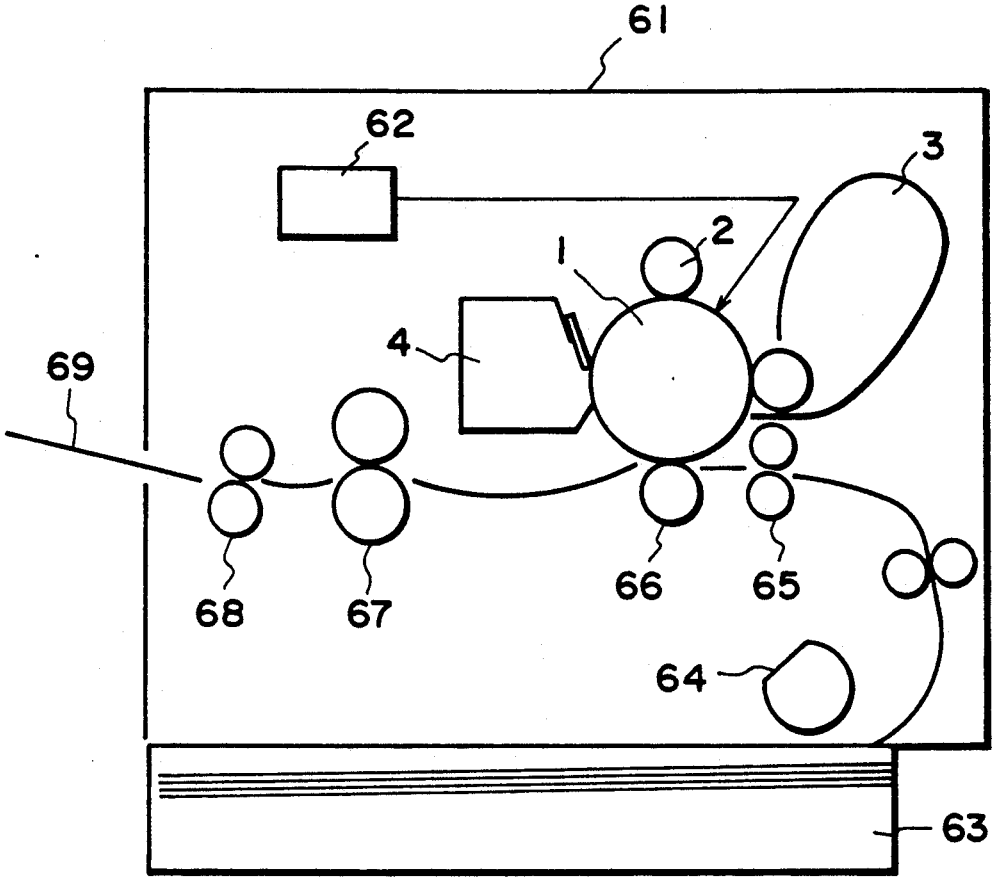
FIG. 6 is a sectional view of an image forming apparatus according to an embodiment of the present invention.

FIG. 6 shows a laser beam printer 61 in which the process cartridge is mounted, the process cartridge containing the photosensitive drum satisfying the above relations between the charging frequency f and the specific weight $\sigma$ of the photosensitive drum, expressed by the lines 1–3.

In operation, the photosensitive drum 1 is uniformly charged by the charging roller 2, and the charged photosensitive drum 1 is exposed to and raster-scanned by a laser beam modulated in accordance with image signal by a laser scanner. By this, an electrostatic latent image is formed on the photosensitive drum 1. The electrostatic latent image is developed by a developing device 3 in such a manner that the toner is deposited to the areas where the potential decreases by the exposure to the laser beam (reverse development). The toner image is transferred onto a transfer material by a transfer roller 66. The transfer material is accommodated in a cassette 63, and is fed out one-by-one by a pick-up roller 64. A printing signal is supplied to the laser beam printer from a host computer. Then, the transfer material is fed out by the pick-up roller 64, and is supplied to the transfer roller 66 in synchronism with the image signal by a timing roller 66. Then,. the toner image is transferred onto the transfer material. The transfer roller 66 comprises an electrically conductive elastic material. A nip is formed between the photosensitive drum 1 and the transfer roller 66, and the image is electrostatically transferred under the transfer bias electric field. The transfer material having received the image is fixed in a fixing device, and is discharged to a discharging tray 69 by discharging rollers. The residual toner remaining on the photosensitive member after the image transfer is removed by a cleaning blade 4.

In such a laser beam printer 61, the charging roller 2 was supplied with AC voltages having a peak-to-peak voltage of 2000 V and frequencies of 400 Hz and 800 Hz.

The aluminum cylinder had a diameter of 30 mm and a thickness satisfying the above-described relations expressed by lines 1–3. More particularly, the thickness of the aluminum cylinder was 1.5 mm for the charging frequency of 400 Hz and was 2.0 mm for 800 Hz. It has been confirmed that the charging noise is hardly leaked outside the laser beam printer.

Thus, if the above conditions are satisfied in the bare process cartridge, that is, the process cartridge itself, the virtual noise source is suppressed, and therefore, the charging noise is hardly amplified in the laser beam printer, and in addition, it is not leaked to the outside of the printer. Therefore, even if the structure of the outer casing of the electrophotographic printer is different, the charging noise can be prevented if the above-described process cartridge is used.

It has been found that in such an image forming apparatus, the charging noise is hardly bothering acoustically outside the apparatus if the charging frequency is not more than 200 Hz. and therefore, the above-described relation between the charging frequency and the specific weight of the photosensitive drum or cylinder is virtually effective when the charging frequency is not less than 200 Hz.

Figure 7:
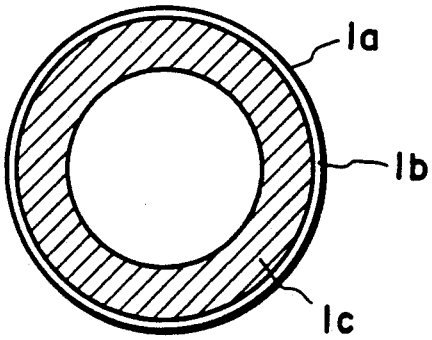
FIG. 7 is a sectional view of an exemplary photosensitive drum usable with the present invention.

The second embodiment will now be described. In this embodiment, a material 1*c* having a certain mass is inserted into the aluminum cylinder 1*b* of the photosensitive drum so as to be in contact with the inside surface thereof as shown in FIG. 7, instead of increasing the thickness of the aluminum cylinder. The usable materials therefor include thermoplastic resin material such as ABS resin, polycarbonate resin or polyacetal resin, thermosetting resin material such as epoxy resin or phenol resin, synthetic resin material such as silicone rubber, urethane rubber, EPDM, chloroprene rubber or NBR, liquid such as water or Si oil, or powdery material such as resin powder or Si powder, or the like, because it is possible to provide such a configuration as to be in close contact with the inside surface of the cylinder 1*b*. In this embodiment, the ABS resin material is used. It is processed into a cylinder having an outer diameter which is substantially the same as the inner diameter of the cylinder 1*b* so as to be in contact with the inside surface of the cylinder. By changing the inner diameter of the ABS resin cylinder 1*c*, the mass thereof is changed. Then, the relation among the charging frequency, the mass and the charging noise has been investigated.

Figure 8:
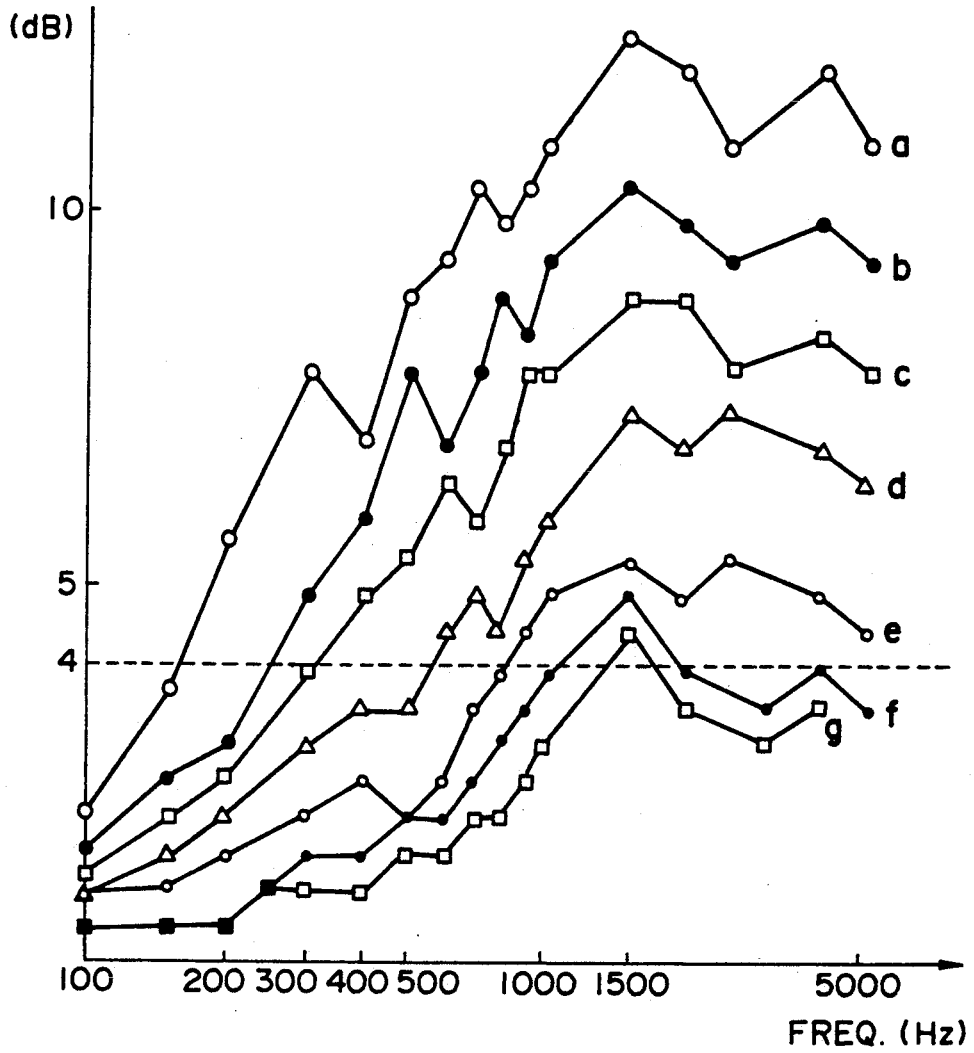
FIG. 8 is a graph of a relation between the charging frequency and charging noise.

FIG. 8 is a graph showing results of the investigation. The ordinate of the graph of FIG. 8 is the same as the ordinate of FIGS. 2 and 4. The outer diameter of the cylinder 1*b* is 30 mm as in Experiment 1. The thickness of the cylinder 1*b* is 0.6 mm, so that the inner diameter of the cylinder 1*b* becomes 28.8 mm. In FIG. 8, a solid line a is for the case of nothing in the photosensitive drum; a solid line b is for the case of ABS cylinder 1*c* having an outer diameter of 28.8 mm, an inner diameter of 26.8 mm (1 mm thick); a solid line c, for the case of the inserted ABS cylinder having an outer diameter of 28.8 mm, an inner diameter of 24.8 mm (2 mm thick); a solid line d, for the case of the inserted ABS cylinder having a thickness of 3 mm and the same outer diameter; a solid line e, for the inserted ABS cylinder having a thickness of 4 mm and the same outer diameter; a solid line f, for the case of the inserted ABS cylinder having a thickness of 5 mm and the same outer diameter; and a solid line g, for the inserted ABS cylinder having a thickness of 7 mm and the same outer diameter. From this graph, the frequency with which the charging noise is not bothering, relative to the thickness of the ABS cylinder, is expressed in the following Table 4.

TABLE 4

| Thickness of ABS Cylinder (mm) | 1 | 2 | 3 | 4 | 5 | 7 |
|---|---|---|---|---|---|---|
| Charging Freq. (Hz) | 250 | 300 | 550 | 800 | 1000 | 1300 |

Figure 9:
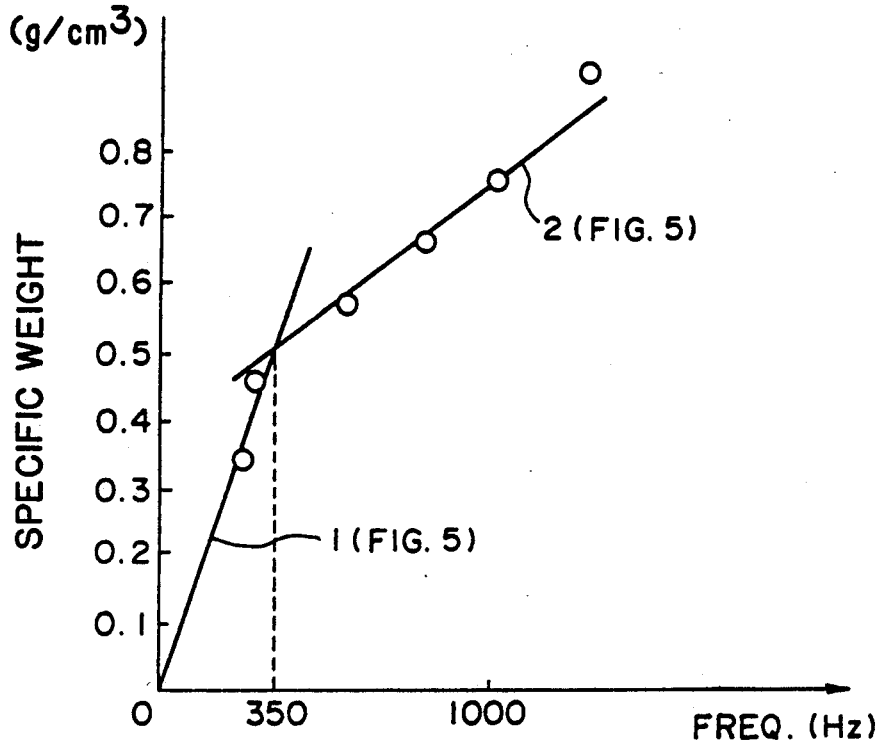
FIG. 9 is a graph of a relation between a charging frequency and a specific weight of the photosensitive drum.

FIG. 9 is a graph of a relation between the specific weight $\sigma$ of the photosensitive drum and the charging frequency with which the charging noise is not bothering, as in the foregoing embodiments. The relation between the specific weight and the thickness of the ABS cylinder inserted into the photosensitive drum, is as follows:

TABLE 5

| ABS Cylinder Thickness (cm) | Specific Weight ($g/cm^3$) |
|---|---|
| 0.1 | 0.34 |
| 0.2 | 0.46 |
| 0.3 | 0.57 |
| 0.4 | 0.67 |
| 0.5 | 0.76 |
| 0.7 | 0.92 |

The specific weight $\sigma$ of the aluminum cylinder is as follows:

$$\sigma=[\{(3/2)^2-(2.88/2)^2\}\times 1.7+\{(2.88/2^2-(2.88/2-t)^2\}\times 1.04]/(3/2)^2$$

where the outer diameter of the aluminum cylinder is 3 cm, the inside diameter thereof is 2.88 cm, the specific gravity of the aluminum cylinder is 2.7 $g/cm^3$, the outer diameter of the ABS cylinder is 2.88 cm, the thickness of the ABS cylinder is t cm, and the specific gravity thereof is 1.04.

As will be understood from the graph of FIG. 9, the relation between the specific weight of the photosensitive drum (the specific weight thereof including the aluminum cylinder and the ABS cylinder) and the charging frequency with which the charging noise is not bothering, can be proximated by rectilinear lines as in FIG. 5. Therefore, the specific weight $\sigma$ of the photosensitive drum ($g/cm^3$) which is preferable for suppressing the charging noise relative to the charging frequency f (Hz) is expressed by the foregoing equations, that is:

$$\sigma \geqq 1.4\times 10^{-3}\times f,\ (200 \leqq f \leqq 350\ Hz)$$

$$\sigma \geqq 4\times 10^{-4}\times f+0.35,\ (350\ Hz < f \leqq 1500\ Hz)$$

$$\sigma \geqq 0.95,\ (f > 1500\ Hz)$$

The same as in the foregoing embodiments applies with respect to the charging frequency not less than 1500 Hz.

As will be understood, in order to suppress the charging noise, the specific weight of the entire photosensitive drum is increased not only by increasing the specific weight by increasing the thickness of the photosensitive drum but also by inserting a material having a certain mass. In this embodiment, the ABS cylinder is inserted into the photosensitive cylinder However, the charging noise can be similarly suppressed by inserting a material having a certain mass and having a configuration capable of in close contact with the inside surface of the cylinder. Further, by selecting the specific weight in relation to the frequency of the AC voltage or AC voltage component applied to the charging roller, any charging frequency can be covered in the laser beam printer using the process cartridge.

Figure 10A:
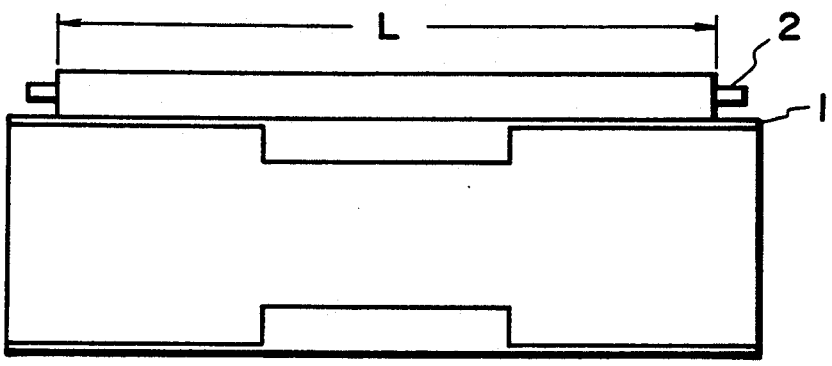
FIGS. 10A and 10B are front views of an exemplary photosensitive drum usable with the present invention.
Figure 10B:
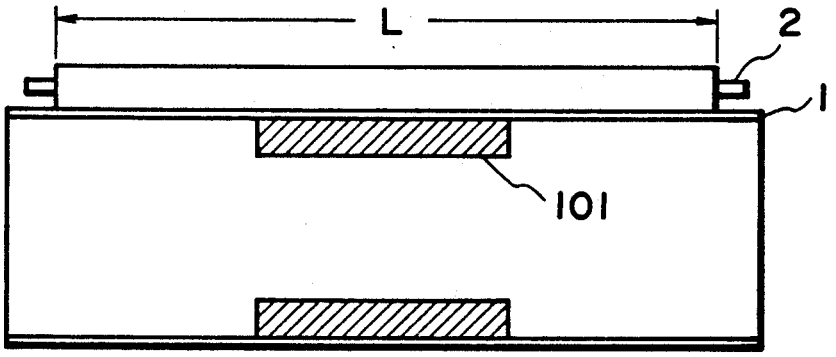

FIGS. 10A and 10B show a third embodiment. The Figures are longitudinal sectional views of the photosensitive drum. In this embodiment, the thickness of the aluminum cylinder is large in the longitudinally central portion (FIG. 10A), and a material is inserted only in the central portion of the aluminum cylinder (FIG. 10B).

The same investigations as in the first and second embodiments have been conducted as to the relation between the charging frequency, the weight of the inside material and the thickness of the cylinder in terms of the non-bothering charging noise. It has been found that the masses which are related with the specific weight in the first and second embodiments, are the weight (g) of the effective charging zone length of the photosensitive drum/an area of an outer diameter of the photosensitive drum (cylinder), that is, the sectional area of the supporting member for the photosensitive layer ($cm^2$)/a length L (cm) of an effective charging zone of the photosensitive drum. Here, the effective charging zone is the zone in which the photosensitive drum is in contact with the charging roller in the longitudinal direction of the photosensitive drum. In the actual experiments, the aluminum cylinder had a diameter of 30 mm, and the thickness of the aluminum cylinder in 100 mm length central portion was changed to be 2 mm, 3 mm, 4 mm and 5 mm, and the thickness of the other portion was 0.6 mm.

As for the case of the material inserted, an ABS cylinder having an outer diameter which is equal to the aluminum cylinder as in the second embodiment and a length of 100 mm is inserted into the aluminum cylinder and is placed at the longitudinally central portion, and the thickness of the ABS cylinder 10 is 4 mm, 6 mm, 8 mm or 12 mm. The thickness of the cylinder is 0.6 mm. The effective charging region of the charging roller has a length of 220 mm.

The following Tables 6 and 7 show a relation between the thickness in the central portion of the cylinder and the charging frequency with which the charging noise is not bothering and a relation between the thickness of the ABS cylinder inserted in the cylinder and the charging frequency with which the charging noise is not bothering, respectively.

TABLE 6

| Al Cylinder Thickness in the Center | 2 mm | 3 mm | 4 mm | 5 mm |
|---|---|---|---|---|
| Charging Frequency | 300 Hz | 500 Hz | 800 Hz | 1100 Hz |

TABLE 7

| Al Cylinder Thickness | 4 mm | 6 mm | 8 mm | 12 mm |
|---|---|---|---|---|
| Charging Frequency | 200 Hz | 300 Hz | 350 Hz | 550 Hz |

Figure 11:
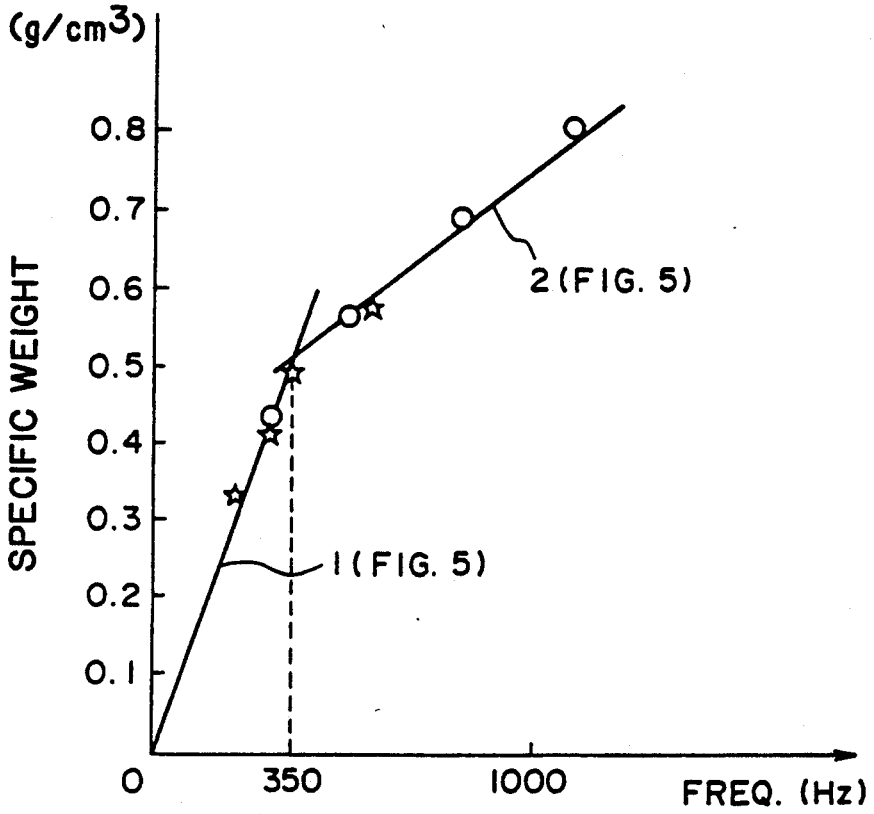
FIG. 11 is a graph of a relation between the charging frequency and the specific weight of the photosensitive drum.

FIG. 11 is a plot of the relation between the charging frequency and the specific weight (as defined in this embodiment), similar to the first and second embodiments. The following Table 8 shows a relation among the thickness of the aluminum cylinder in the central portion, the thickness of the ABS cylinder and the specific weight.

TABLE 8

| | Specific Weight ($g/cm^3$) |
|---|---|
| Al Cylinder Thickness in the Center (cm) | |
| 0.2 | 0.43 |
| 0.3 | 0.56 |
| 0.4 | 0.68 |
| 0.5 | 0.80 |
| ABS Cylinder Thickness (cm) | |
| 0.4 | 0.33 |
| 0.6 | 0.42 |
| 0.8 | 0.49 |
| 1.2 | 0.57 |

The specific weight $\sigma$ ($g/cm^3$) is calculated from the value obtained by dividing the weight W (g) of the photosensitive drum in the effective charging zone L (22 cm) by the product of the sectional area of the photosensitive drum (the area of a circle having a diameter which is equal to the outer diameter of the cylinder) S ($cm^2$) and the effective charging zone length L (cm), that is, $\sigma = W/SL$).

The weight W (g) of the photosensitive drum in the effective charging zone is expressed as follows:

$$W=\{(1.5/2)^2-(1.5/2-t_1)^2\}\times 2.7\times 10+\{(1.5/2)^2-(1.5/2-0.6)^2\}\times 2.7\times(22-10)$$

where the specific weight of aluminum is 2.7 ($g/cm^3$), the specific weight of the ABS material is 1.04 ($g/cm^3$), the thickness of the aluminum cylinder in the central portion is $t_1$ (cm), the thickness of the ABS cylinder is $t_2$ (cm), and the length of the thick portion is 10 cm.

The above is for the case in which the thickness is increased in the central portion.

When the ABS cylinder having a length of 10 cm is inserted, it is expressed as follows:

$$W=\{(1.5/2)^2-(1.5/2-t_2)^2\}\times 1.04\times 10+\{(1.5/2)^2-(1.5/2-0.6)^2\}\times 2.7\times(22-10)$$

From FIG. 11, also in this embodiment similar to the foregoing embodiments, the relation between the specific weight of the photosensitive drum and the charging frequency with which the charging noise is not bothering, is approximated substantially by the lines of FIG. 5 graph, and therefore, the specific weight $\sigma$ ($g/cm^3$) of the photosensitive drum which is proper to suppress the charging noise relative to the charging frequency f (Hz) is the same as the foregoing equations, that is:

$$\sigma \geqq 1.4\times 10^{-3}\times f,\ (200 \leqq f \leqq 350\ Hz)$$

$$\sigma \geqq 4\times 10^{-4}\times f+0.35,\ (350\ Hz < f \leqq 1500\ Hz)$$

$$\sigma \geqq 0.95,\ (f > 1500\ Hz)$$

The same as in the foregoing embodiments applies to the charging frequency not less than 1500 Hz.

As will be understood from the foregoing, in order to prevent the charging noise, the increase of the mass of the photosensitive drum at the central portion only (at least 50 mm length or at least 20% length of the effective charging length), is effective, if the specific weight definition of this invention is used, similar to the first and second embodiments. According to this embodiment, the length of the ABS cylinder or the like is shorter, and therefore, the inserting operation or the like is easier, and in addition, the close contact thereof to the inside surface of the cylinder is assured.

The reason why the charging noise suppressing effect is produced by increasing the specific weight of the photosensitive drum will now be described. When the oscillating voltage is applied between the photosensitive drum and the charging roller, an oscillating electric field is formed therebetween to forceably vibrate the charging roller and the photosensitive drum. The vibration is relatively large in the charging roller and relatively small in the photosensitive drum. It has been found by the inventors that the noise produced by the vibration of the photosensitive drum and the noise produced by containers constituting the process cartridge, such as a cleaner container, a process cartridge cover or the like as a result of transmission of the vibration from the photosensitive drum, are more significant than the noise produced by the vibration of the charging roller. The same applies to the image forming apparatus because the vibration is transmitted to the side plates or the cleaner of the image forming apparatus, where the photosensitive drum is directly supported on a frame of the image forming apparatus. Such charging noise is remarkable when the photosensitive drum is rotated, and the photosensitive drum and the process cartridge container are vibrated in accordance with the charging frequency. The vibration is produced by the oscillating electric field, and includes partial nodes and loops. As described hereinbefore, it substantially increases monotonically, and therefore, the influence of the resonance is hardly observed. In order to suppress the charging noise, therefore, it is more effective to suppress the vibration of he photosensitive drum and the process cartridge container than to suppress the vibration of the charging roller. It has been found by the inventors that the suppression of the photosensitive drum vibration is more effective.

As described with embodiments 1-3, the increase of the specific weight of the photosensitive drum is significant in order to suppress the vibration of the photosensitive drum.

It is generally known that the vibration decreases in accordance with the mass. The same charging noise preventing effect can be provided on the basis of the same concept of the specific weight equally for the increase of the cylinder thickness and for the insertion of the material having a certain mass (ABS cylinder or the like). The reason for this is not clear, but is considered as follows. In the system in which the ABS cylinder is in the photosensitive drum, the suppression effect is not as remarkable when the photosensitive drum is not rotated as in the system in which the thickness of the aluminum cylinder is increased. However, it has the same advantageous effect as the system of the increased thickness, then the photosensitive drum is rotated. This is shown in Table 9 below.

TABLE 9

| | Non-rotating | Rotating |
|---|---|---|
| Al Cylinder = 2 mm | 38 dB | 48 dB |

TABLE 9-continued

| | Non-rotating | Rotating |
|---|---|---|
| (Specific Weight = 0.67 g/cm$^3$) Al Cylinder = 0.6 mm | (35 dB) | (45 dB) |
| ABS cylinder of 4 mm thick in Al Cylinder (Specific Weight = 0.67 g/cm$^3$) | 41 dB (35 dB) | 48.5 dB (45 dB) |

( ): Noise pressure level without application of oscillating voltage

With this table, the measuring conditions are the same as in the foregoing experiments, and the charging frequency was 800 Hz. Thus, the concept of the specific weight is significantly effective from the standpoint of suppressing the vibration when the rotatable member is rotated. The reason is considered as follows. The mass of the material in the inside of the photosensitive drum suppresses the vibration of the aluminum cylinder by the centrifugal force.

In order to prevent the forced vibration during the rotation of the photosensitive drum, the bonding of a vibration buffering materials alone for the purpose of preventing the resonance, as disclosed in Japanese Laid-Open Patent Application No. 45981/1991, is not sufficient, and it is required that a uniform mass exist all over the circumference of the photosensitive drum.

In summary, for the purpose of suppressing the noise caused by the oscillating electric field, it is more effective, rather than to suppress the vibration of the most vibrating member (charging roller in this embodiment), to suppress the vibration of the rotatable member (photosensitive drum in this embodiment) functioning as a path for transmitting the vibration to the other member such as a container of the cartridge. Here, the specific weight of the rotatable member, that is, the photosensitive drum is the weight (g) of the effective charging zone of the photosensitive drum divided by (cross-sectional area of the photosensitive drum (cm$^2$) $\times$length of the effective charging zone of the photosensitive drum (cm)), applicable to all of the embodiments 1-3. The charging noise can be suppressed if the specific weight is selected so that the relations described in the description of the embodiments are satisfied relative to the charging frequency of the vibrating electric field applied to the contact type charging device.

In the foregoing description, only the charging frequency is taken as a parameter when the specific weight of the photosensitive drum is considered. The reason for this is as follows.

According to the inventor's investigations, the charging noise is dependent on the hardness of the charging roller, the surface roughness, the waveform of the applied AC voltage and the peak-to-peak voltage, but the contributions of these parameters to the charging noise are not significant in the range of the good charging properties being provided. As regards the hardness of the charging roller, for example, the roller is kept press-contacted to the photosensitive drum 1 for a long period of time where the charging roller is provided in the cartridge. In view of this, the elastic layer of the charging roller 2 has such a property that the permanent deformation due to compression is small. The permanent deformation due to pressure is large if the hardness of the elastic layer is large. When the elastic layer is made of silicone rubber, urethane rubber or EPDM, the roller hardness of the charging roller 2 in the process cartridge is at least 50 degrees (Asker C, 1 kgf). In such a hardness region, the roller hardness is not significantly influential to the charging noise. More particularly, the contribution is 1 dB/5 degrees (the charging noise decreases by 1 dB when the roller hardness is reduced by 5 degrees), in the measurement method described hereinbefore. The charging noise can be decreased by roughing the surface, but the charging noise is not decreased unless the ten point average surface roughness Rz is larger than 25 microns. However, the surface roughness Rz is preferably less than 20 microns for the good charging properties, according to the inventor's investigations, and therefore, the charging noise preventing effect by roughing the surface is not significantly expected.

As for the oscillating voltage applied to the charging roller and the photosensitive drum, it may be in the form of a sine wave as in the foregoing embodiments, a triangular wave or a rectangular wave. It may be a pulse wave provided by rendering on and off a DC voltage source. In other words, the voltage is usable if it periodically changes with time. The sine wave does not contain the high frequency components, and therefore, the sine wave is preferable since the charging noise is small.

When the peak-to-peak voltage of the oscillating voltage is decreased, the charging noise decreases, but the spot-like charging tends to occur. As shown in Japanese Laid-Open Patent Application No. 149669/1988, the good charging performance can be provided when the voltage applied between the photosensitive drum and the charging roller has a peak-to-peak voltage which is not less than twice the charge starting voltage which is the voltage when the charging of the photosensitive drum occurs if only the DC voltage is applied to the charging roller. When the OPC photosensitive member has a thickness of 20 microns, for example, the good charging performance can be provided with the peak-to-peak voltage of 1200-2500 V. Here, the upper limit is provided by the abnormal discharging from the charging roller 2 to the photosensitive drum. In this region, the charging noise suppressing effect is at most 1 dB/400 V (the charging noise decreases by 1 dB by reducing the peak-to-peak voltage by 400 V) in the measuring method described in the foregoing, according to the investigations of the inventors. Therefore, it is not very effective to suppress the charging noise.

Accordingly, with regard to the charging noise, the charging frequency is significant factor in the good charging performance range.

In the foregoing embodiment, the description has been made with respect to the charging roller, but the present invention is applicable to another contact type charging device such as a charging blade, as has been confirmed by the inventors. As for the image forming apparatus usable with the present invention, the description has been made with respect to a laser beam printer using a process cartridge, but the same advantageous effects can be provided in the case of another image forming apparatus such as an electrophotographic printer or a copying machine. Even in the case of the image forming apparatus in which the photosensitive drum, the charging roller, the developing device, the cleaner or the like are not constituted as a unit but are replaceable separate units, the charging noise suppression effect can be provided by using the above-described relation between the charging frequency and the specific weight of the photosensitive drum. In the foregoing embodiments, the process cartridge contains, as a unit, the developing device, the cleaner, the contact charging device and the photosensitive drum, but the same applies to the process cartridge without the developing device.

As described in the foregoing, because of the relation between the specific weight o of the supporting member of the member to be charged and the frequency f of the oscillating voltage applied between the member to be charged and the charging member, the deformation of the member to be charged decreases, so that the vibration due to the deformation is reduced. Therefore, the solid noise produced thereby is reduced. This suppresses the charging noise produced from the process cartridge of the image forming apparatus. The quiet operation improves the empirement together with the low production of the ozone by the contact type charging system.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus, comprising:

a charging member contactable to a member to be charged; and voltage application means for applying an oscillating voltage between the member to be charged and said charging member;

wherein a specific weight $\sigma$ of the member to be charged defined by weight of an effective charging zone of the member to be charged (g) divided by (cross-sectional area thereof ($cm^2$) $\times$length of effective charging zone (cm)) and a frequency f (Hz) of the oscillating voltage satisfy:

$$\sigma \geqq 1.4\times10^{-3}\times f,\ (200 \leqq f \leqq 350\ Hz)$$

$$\sigma \geqq 4.0\times10^{-4}\times f+0.35,\ (350\ Hz < f \leqq 1500\ Hz)$$

$$\sigma \geqq 0.95,\ (f > 1500\ Hz).$$

2. A process cartridge usable with an image forming apparatus, comprising:

an image bearing member;

a charging member contactable to said image bearing member to electrically charge said image bearing member, wherein an oscillating voltage is applied between said charging member and said image bearing member;

wherein a specific weight $\sigma$ of said image bearing member defined by weight of an effective charging zone of said image bearing member (g) divided by (cross-sectional area thereof ($cm^2$) $\times$length of effective charging zone (cm)) and a frequency f (Hz) of the oscillating voltage satisfy:

$$\sigma \geqq 1.4\times10^{-3}\times f,\ (200 \leqq f \leqq 350\ Hz)$$

$$\sigma \geqq 4.0\times10^{-4}\times f+0.35,\ (350\ Hz < f \leqq 1500\ Hz)$$

$$\sigma \geqq 0.95,\ (f > 1500\ Hz).$$

3. An image forming apparatus, comprising:

an image bearing member;

a charging member contactable to said image bearing member to electrically charge said image bearing member, wherein an oscillating voltage is applied between said charging member and said image bearing member;

wherein a specific weight o of said image bearing member defined by weight of an effective charging zone of said image bearing member (g) divided by (cross sectional area thereof ($cm^2$) $\times$length of effective charging zone (cm)) and a frequency f (Hz) of the oscillating voltage satisfy:

$$\sigma \geqq 1.4\times10^{-3}\times f,\ (200 \leqq f \leqq 350\ Hz)$$

$$\sigma \geqq 4.0\times10^{-4}\times f+0.35,\ (350\ Hz < f \leqq 1500\ Hz)$$

$$\sigma \geqq 0.95,\ (f > 1500\ Hz).$$

4. An apparatus according to claim 3, wherein said charging member is in the form of a roller.

5. An apparatus according to claim 3, wherein said oscillating voltage includes an AC voltage component and a DC voltage component.

6. An apparatus according to claim 3, wherein said image bearing member includes a surface photosensitive layer and a supporting member for supporting the photosensitive layer.

7. A device or apparatus according to claim 1 or 6, wherein a mass of the member to be charged or said image bearing member is different at a longitudinally central portion than at marginal portions.

8. A device or apparatus according to claim 7, wherein the mass is larger in the central portion than in the marginal portions.

9. A device or apparatus according to claim 8, wherein the mass is increased in the central portion by addition of a material.

10. An apparatus according to claim 6, wherein said image bearing member is provided with an additional material therein.

11. An apparatus according to claim 6, wherein said image bearing member has a different thickness at a longitudinally central portion thereof than marginal portions.

12. An apparatus according to claim 11, wherein said image bearing member has a larger thickness in a longitudinally central portion than marginal portions.

13. An apparatus according to claim 6, wherein said image bearing member is provided therein with a material contacted thereto.

14. An apparatus according to claim 13, wherein the material is provided only in a longitudinally central portion.

* * * * *

UNITED STATES PATENT AND TRADEMARK OFFICE

CERTIFICATE OF CORRECTION

PATENT NO. : 5,272,506 Page 1 of 3

DATED : December 21, 1993

INVENTOR(S) : Masahiro Goto, et al.

It is certified that error appears in the above-indentified patent and that said Letters Patent is hereby corrected as shown below:

Title page, Item

[57] Abstract

Line 13, "f(200)" should read --f, (200)--.

COLUMN 1:

Line 18, "conductive" should read --conductive roller--.

COLUMN 2:

Line 33, "mall" should read --small--.

COLUMN 4:

Line 53, "currents" should read --current--.

COLUMN 5:

Line 40, "are" should read --is--.
Line 47, "line d," should read --line f,--.
Line 63, "as, the" should read --as the--.

UNITED STATES PATENT AND TRADEMARK OFFICE

CERTIFICATE OF CORRECTION

PATENT NO. : 5,272,506

DATED : December 21, 1993

INVENTOR(S) : Masahiro Goto, et al.

It is certified that error appears in the above-indentified patent and that said Letters Patent is hereby corrected as shown below:

COLUMN 7:

Line 16, "the, frequency," should read --the frequency,--.
Line 51, "Then,." should read --Then,--.

COLUMN 9:

Line 44, "proximated" should read --approximated--.

COLUMN 10:

Line 2, "capable of" should be deleted.

COLUMN 12:

Line 41, "he" should read --the--.

COLUMN 13:

Line 20, "a" should be deleted.

UNITED STATES PATENT AND TRADEMARK OFFICE

CERTIFICATE OF CORRECTION

PATENT NO. : 5,272,506 Page 3 of 3

DATED : December 21, 1993

INVENTOR(S) : Masahiro Goto, et al.

It is certified that error appears in the above-indentified patent and that said Letters Patent is hereby corrected as shown below:

COLUMN 15:

Line 5, "weight o" should read --weight $\delta$--.
Line 14, "empirement" should read --embodiment--.

COLUMN 16:

Line 12, "weight o" should read --weight $\delta$--.
Line 15, "(cross sectional" should read --(cross-sectional--.

Signed and Sealed this

Thirteenth Day of September, 1994

*Attest:*

Bruce Lehman

BRUCE LEHMAN

*Attesting Officer*

*Commissioner of Patents and Trademarks*